US006183243B1

(12) United States Patent
Snyder

(10) Patent No.: US 6,183,243 B1
(45) Date of Patent: Feb. 6, 2001

(54) METHOD OF USING NUCLEAR WASTE TO PRODUCE HEAT AND POWER

(76) Inventor: Stuart Snyder, 208 Baypoint Dr., San Rafael, CA (US) 94901

( * ) Notice: Under 35 U.S.C. 154(b), the term of this patent shall be extended for 0 days.

(21) Appl. No.: 09/379,213

(22) Filed: Aug. 23, 1999

(51) Int. Cl.[7] ..... F27D 17/00

(52) U.S. Cl. ..... 432/28; 432/30; 60/644.1; 250/506.1; 376/272; 376/347

(58) Field of Search ..... 432/4, 5, 28, 30, 432/31; 237/12.1, 81; 376/260, 272, 347; 588/1; 250/506.1, 515.1; 60/644.1

(56) References Cited

U.S. PATENT DOCUMENTS 3,404,722 10/1968 Bloore .
3,435,617 4/1969 Wagle .
3,624,759 * 11/1971 Carlson ..... 165/104.31
3,656,300 * 4/1972 Wikdahl ..... 376/347
3,866,424 2/1975 Busey .
3,911,684 * 10/1975 Busey ..... 60/644.1
4,031,952 * 6/1977 Contour ..... 165/104.31
4,288,989 * 9/1981 Cassidy ..... 60/685
4,404,165 9/1983 Heskey et al. .
4,776,982 10/1988 Canevall .
4,987,313 * 1/1991 Baatz et al. ..... 250/506.1

* cited by examiner

*Primary Examiner*—Gregory Wilson
(74) *Attorney, Agent, or Firm*—Johnson & Stainbrook, LLP; Craig M. Stainbrook; Larry D. Johnson

(57) ABSTRACT

A method of using nuclear waste material and exploiting heat generated by radioactive decay of said radioactive waste, comprising the steps of incorporating solid nuclear waste into glass, ceramic, or cementitious blocks, covering the blocks in heat absorbing sealed containers, placing the sealed containers in a columnar arrangement in a gas tight containment room, circulating a heat exchange gas around said containers, passing the heated gas through a sealed heat exchanger, and using the heated water for useful work.

16 Claims, 1 Drawing Sheet

METHOD OF USING NUCLEAR WASTE TO PRODUCE HEAT AND POWER

BACKGROUND OF THE INVENTION

1. Field of the Invention

The present invention relates to a method for using nuclear waste to produce heat and/or power.

2. Description of the Prior Art

Most countries using nuclear production reactors dispose of radioactive fission waste products by depositing the radioactive material in subterranean vaults or underground rock formations, well below the earth's surface and a safe distance from any moving water source. Storage vaults may comprise deep vertical wells or horizontal tunnel corridors with tunnel rooms extending laterally from the corridors. The latter method is taught in Crichlow U.S. Pat. No. 5,850,614. Prior to deposition in vaults, the waste may be mixed with materials and converted into solid form having high chemical and structural stability. For example, radioactive oxides can be melted into a borosilicate glass or, alternatively, a lead iron phosphate glass, as taught by Boatner et al U.S. Pat. No. 4,847,008, or a polymeric phosphate glass, as taught in Ropp U.S. Pat. No. 4,351,749. The glass mixture is typically poured into steel canisters or cylinders, solidified, sealed by welding or multiple lock systems, and overpacked with bentonite clay. The canisters are then placed into the subterranean storage chambers.

Nuclear waste storage and disposal is a highly charged social and political issue, therefore nuclear waste often stays at temporary storage sites while interested factions debate its future. The present invention provides a method for making practical and possibly temporary use of nuclear waste, while also ensuring environmental integrity and human safety.

SUMMARY OF THE INVENTION

It is well known in the art to incorporate nuclear waste products from nuclear production reactors into glass, ceramic, or cementitious blocks. The waste so incorporated may be solid nuclear waste, such as spent nuclear reactor fuel rods, or it may be liquid waste products reduced to solid form and then oxidized. The present invention exploits the heat generated by the decay of radioactive waste embodied in this fashion by placing cast blocks containing radioactive waste in a containment room where gas is circulated around the blocks as a heat exchange medium. The gas is drawn into a sealed heat exchanger where it heats water or other fluid recruited to perform some useful work such as the generation of heat and/or power.

The containment room may be subterranean or above-ground and is bordered by a cement or earth fill wall engineered to reduce radioactivity to safe levels. When sealed, the room will be gas tight. Prior to placement, radioactive waste will be incorporated into cast glass, ceramic, or cementitious blocks and jacketed in containers. The containers will optimize radiation absorption and heat exchange.

The containers will then be transferred to the containment room manually or through other material handling means and arranged in columns and rows. An inlet port will be provided to introduce a heat exchange gas. The gas will be circulated among the containers and drawn through an outlet port into a sealed heat exchanger. Numerous uses may be made of the heated heat exchange fluid, including steam turbine power generation, building heat or warm water irrigation.

Monitoring and inspection of the containers will be performed by shielded monitors and robots stored in an adjacent maze.

DETAILED DESCRIPTION OF A PREFERRED EMBODIMENT

Figure 1:
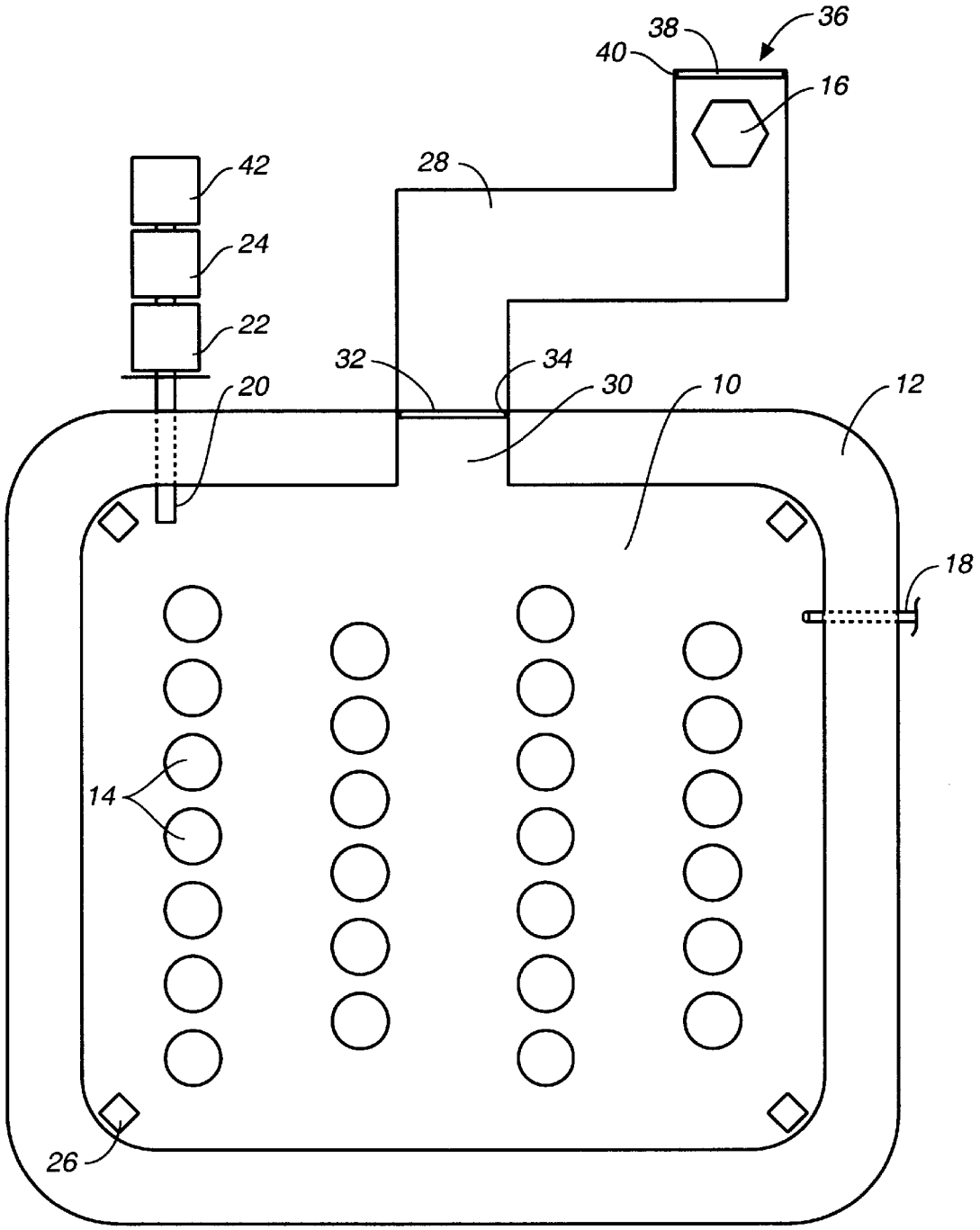
FIG. 1 is a plan view of the containment room and related components of the method for using nuclear waste to produce heat and power of the present invention.

Referring to FIG. 1, a plan view of the containment room and related components of the present invention, the containment room 10 may be subterranean or above-ground. Preferably it is subterranean and lined with a concrete or earth fill wall 12 of sufficient thickness to minimize external radioactive levels according to accepted nuclear waste form engineering practices. When sealed, the room will also be gas tight. Dimensions of the containment room may be adapted to heat generation needs, disposal needs and schedules, rates of waste production, and monitoring capabilities, but one size could be roughly twenty feet in width and breadth and have a ten to twelve foot ceiling height.

Preliminary to placement in room 10, radioactive waste may be stored in long-life containers 14 in the form of columns. It is well known that radioactive waste in solution may be evaporated until radioactive products are in the solid state. The solid products may be heated to maximize oxide production, and the products can alone or in combination with other solid radioactive waste, such as spent nuclear fuel rods, be incorporated in a borosilicate glass, lead iron phosphate glass, polymeric phosphate glass, ceramic or cementitious forms. In the present method, any one or a combination of such materials and methods may be suitable, and such do not comprise an element of the present invention. However, the forms are preferably either cylindrical blocks or substantially flat plates.

Once the radioactive waste is embodied as described, it will be placed (if solid) or poured (if still fluid) into heat absorbing containers and sealed. The configuration of the containers 14 will be of a design to facilitate heat transfer with the ambient atmosphere. Heat exchanging fins may be added for this reason.

The containers will then be transferred to containment room 10 by suitable means, either manually or by other material handling means, such as a robot 16. The containers 14 will be placed in rows for efficient heat transfer, monitoring, and future handling and transfer. At least one inlet port 18 will be provided for the introduction of a heat exchange gas, such as molecular nitrogen. The nitrogen will be circulated among the containers and drawn through an outlet port 20 into a sealed heat exchanger 22 positioned immediately outside and adjacent to the containment room walls. FIG. 1 shows that a steam generator 24 may be driven by water heated in the exchange, but numerous other applications are contemplated, including building heat and warm water irrigation. In the event sufficient thermal energy can be generated from the cylinders, an electric power generator 42 may derive the remaining electricity generating potential from the nuclear material.

To eliminate the risk of radiation exposure, monitoring and inspection of the containers 14 will be performed by shielded monitors 26 and the previously mentioned robot 16, the latter protected from reflected radiation while not in use by being stored at the end of a maze 28 extending outwardly from a containment room exit 30. The room exit is closed by an exit door 32 having a metal seal or gasket 34. The maze terminates in a maze exit 36, which is also sealed closed by a maze exit door 38 having a metal seal or gasket 40.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A method for using nuclear waste to produce heat or power, said method comprising the steps of:

incorporating nuclear waste in at least one solid composition block;

covering said at least one solid composition block in at least one heat absorbing sealed container;

transferring said at least one sealed container to a gas tight containment room;

arranging said at least one sealed container in rows and columns in said containment room so that said containers are not in physical contact with one another;

introducing cool molecular gas into said gas tight containment room through a gas inlet port;

circulating said molecular gas around and among said at least one container to heat said molecular gas;

drawing off said heated molecular gas through a gas outlet port; and circulating said heated molecular gas through a sealed heat exchanger to perform work.

2. The method according to claim 1 further comprising the steps of:

providing an exit to said containment room, having a door for sealing said exit;

providing a hallway extending outwardly from said exit door, having at least two angled turns to reduce the number of radioactive emissions which travel to the end of said hallway; and providing at least one robot, said robot to be stored at the end of said hallway, said robot capable of monitoring the integrity of said gas tight room and the heat output of individual sealed containers.

3. The method according to claim 1 wherein said nuclear waste incorporated in said at least one solid composition block comprises spent nuclear fuel rods.

4. The method according to claim 1 wherein said nuclear waste incorporated in said at least one solid composition block comprises liquid nuclear waste reduced to solid form and heated to maximize oxide production.

5. The method according to claim 1 wherein said nuclear waste incorporated in said at least one solid composition comprises a combination of liquid nuclear waste reduced to solid form and heated to maximize oxide production and spent nuclear fuel rods.

6. The method according to claim 1 wherein said solid block is a composition of borosilicate glass and solid nuclear waste.

7. The method according to claim 1 wherein said solid block is a composition of lead phosphate glass and solid nuclear waste.

8. The method according to claim 1 wherein said solid block is a composition of polymeric phosphate glass.

9. The method according to claim 1 wherein said solid block is substantially cylindrical in shape.

10. The method according to claim 1 wherein said solid block is formed into a plate-like shape.

11. The method according to claim 1 wherein said heat absorbing sealed container includes fins for increased heat transfer.

12. The method according to claim 1 wherein said molecular gas introduced into said room comprises nitrogen gas.

13. The method according to claim 1 wherein said work performed by said heat exchanger comprises turning a steam powered turbine.

14. The method according to claim 1 wherein said work performed by said heat exchanger comprises building heating.

15. The method according to claim 1 wherein said work performed by said heat exchanger comprises warm water irrigation.

16. A method for using nuclear waste to produce heat or power, said method comprising the steps of:

incorporating nuclear waste in at least one solid composition block;

covering said at least one solid composition block in at least one heat absorbing sealed container;

transferring said at least one sealed container to a gas tight containment room;

arranging said at least one sealed container in rows and columns in said containment room so that said containers are not in physical contact with one another;

introducing cool molecular gas into said gas tight containment room through a gas inlet port;

circulating said molecular gas around and among said at least one container to heat said molecular gas;

drawing off said heated molecular gas through a gas outlet port;

circulating said heated molecular gas through a sealed heat exchanger to perform work;

providing an exit to said containment room, having a door for sealing said exit;

providing a hallway extending outwardly from said exit door, having at least two angled turns to reduce the number of radioactive emissions which travel to the end of said hallway; and providing at least one robot, said robot to be stored at the end of said hallway, said robot capable of monitoring the integrity of said gas tight room and the heat output of individual sealed containers.

* * * * *